US007252079B1

(12) United States Patent
Walker

(10) Patent No.: US 7,252,079 B1
(45) Date of Patent: Aug. 7, 2007

(54) SAFE AIR-PRESSURE-LAUNCHED TOY ROCKET SYSTEM AND METHOD OF ENTERTAINING

(76) Inventor: Brian W. Walker, 21165 Scottsdale Dr., Bend, OR (US) 97701

( * ) Notice: Subject to any disclaimer, the term of this patent is extended or adjusted under 35 U.S.C. 154(b) by 103 days.

(21) Appl. No.: 11/288,698

(22) Filed: Nov. 28, 2005

Related U.S. Application Data

(60) Provisional application No. 60/631,878, filed on Dec. 1, 2004.

(51) Int. Cl.
*F41B 11/00* (2006.01)

(52) U.S. Cl. ..... 124/65; 124/71; 124/73

(58) Field of Classification Search ..... 124/56, 124/60, 63–65, 69, 70, 71, 73, 61
See application file for complete search history.

(56) References Cited

U.S. PATENT DOCUMENTS 2,733,699 A * 2/1956 Krinsky ..... 124/69
3,937,191 A * 2/1976 Green ..... 124/57
4,223,472 A * 9/1980 Fekete et al. ..... 446/192
5,415,153 A * 5/1995 Johnson et al. ..... 124/63
5,819,717 A * 10/1998 Johnson et al. ..... 124/65
5,839,940 A * 11/1998 Ensmenger ..... 446/212
6,321,737 B1 * 11/2001 Johnson et al. ..... 124/73
6,347,623 B1 * 2/2002 Kownacki et al. ..... 124/56
2005/0009440 A1 * 1/2005 Foster et al. ..... 446/231

* cited by examiner

*Primary Examiner*—Troy Chambers
*Assistant Examiner*—Stewart Knox
(74) *Attorney, Agent, or Firm*—Andrew F. Knight

(57) ABSTRACT

A safe air-pressure-launched toy rocket system includes an air-pressure-launched toy rocket, a high pressure reservoir, a manual air pump connected to the reservoir and configured to enable a user to pump air into the reservoir to a high pressure, a valve connected to the reservoir and configured, when opened, to release high pressure air stored in the high pressure reservoir to the toy rocket to launch the toy rocket, and two releases configured to be operable by different hands of the user. The releases are connected to the valve in a series-open configuration, where the valve is closed only when both of the releases are operated.

20 Claims, 4 Drawing Sheets

SAFE AIR-PRESSURE-LAUNCHED TOY ROCKET SYSTEM AND METHOD OF ENTERTAINING

REFERENCE TO RELATED APPLICATION

The present application claims priority to U.S. Patent Application No. 60/631,878, filed Dec. 1, 2004, entitled "Safe Air-Pressure-Launched Toy Rocket System and Method of Entertaining," the disclosure of which is hereby incorporated by reference.

BACKGROUND

Rockets have proven fun and educational toys for many generations, for adults and children alike. However, toy rockets are often accompanied by various hazards, particularly for pyrotechnic-type rockets (e.g., utilizing solid rocket engines that burn a mixture of a solid fuel and oxidizer). Part of this problem may be alleviated by using non-pyrotechnic toy rockets, that utilize, e.g., high-pressure air and/or water under high pressure. However, even such toy rockets are accompanied by the danger of being used as projectile weapons, or of an accident resulting in a toy rocket impacting the launcher's head or face.

SUMMARY OF THE INVENTION

There is a need for a fun, educational toy rocket launching system that minimized or eliminates these dangers. The present invention aims to solve one or more of these and other problems.

According to one embodiment of the present invention, a safe air-pressure-launched toy rocket system comprises: an air-pressure-launched toy rocket; a high pressure reservoir; a manual air pump connected to the reservoir and configured to enable a user to pump air into the reservoir to a high pressure; a valve connected to the reservoir and configured, when opened, to release high pressure air stored in the high pressure reservoir to the toy rocket to launch the toy rocket; and two releases configured to be operable by different hands of the user, wherein the releases are connected to the valve in a series-open configuration, whereby the valve is closed only when both of the releases are operated.

DETAILED DESCRIPTION

In the following description, the use of "a," "an," or "the" can refer to the plural. All examples given are for clarification only, and are not intended to limit the scope of the invention.

Figure 1:
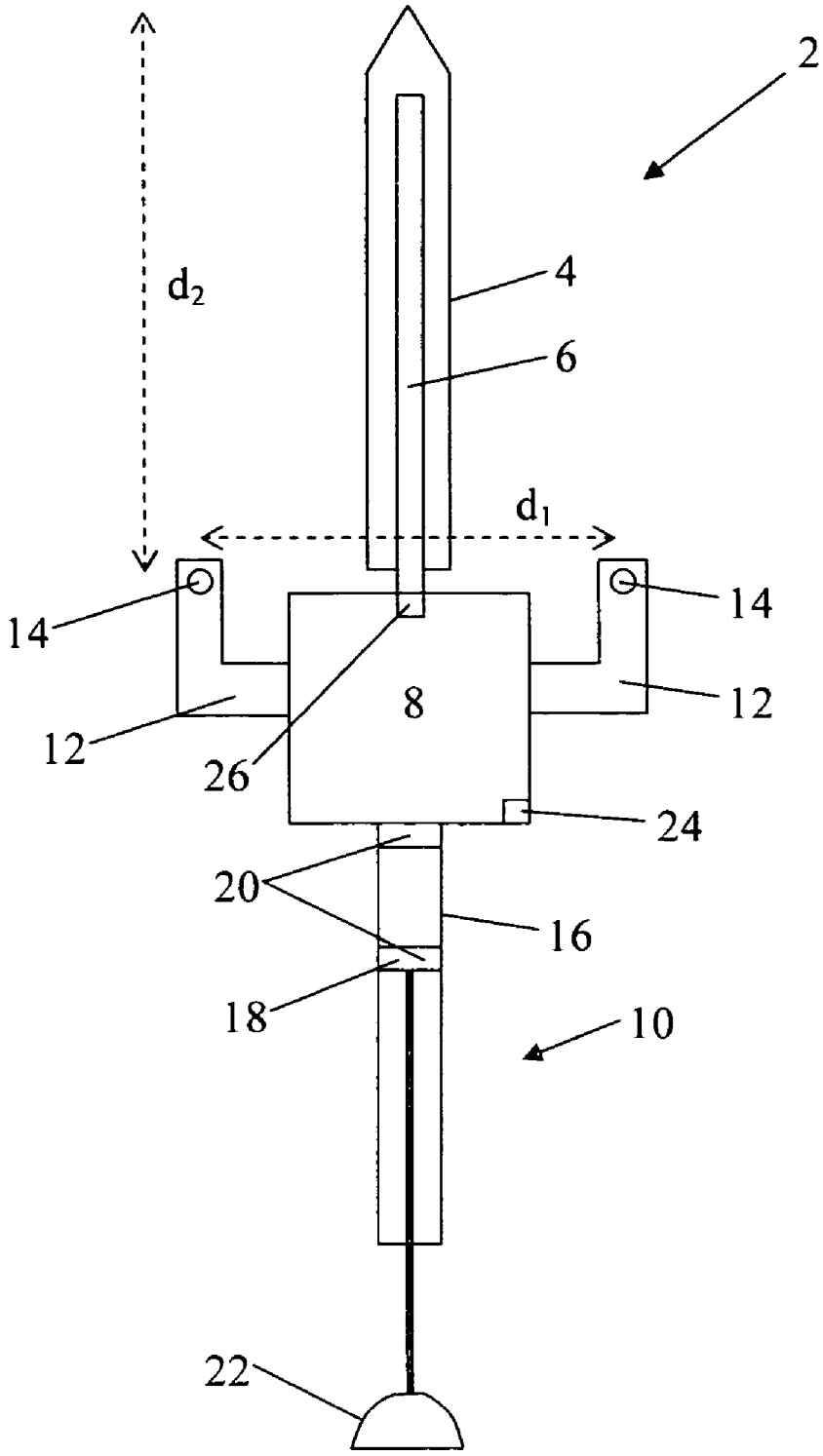
FIG. 1 shows a cross sectional view of a toy rocket system according to one embodiment of the present invention.

Referring now to FIG. 1, a safe air-pressure-launched toy rocket system 2 comprises: an air-pressure-launched toy rocket 4, a high pressure reservoir 8, a manual air pump 10 connected to the reservoir 8 and configured to enable a user to pump air into the reservoir 8 to a high pressure, a valve 26 connected to the reservoir 8 and configured, when opened, to release high pressure air stored in the high pressure reservoir 8 to the toy rocket 4 to launch the toy rocket 4, two handles 12 that may be connected to the reservoir 8, two releases 14 connected to the handles 12 and configured to be operable by different hands of the user, a nipple 6 along which the toy rocket 4 slides, such that the high pressure air is released from the high pressure reservoir 8 to the toy rocket 4 via the nipple 6, and a pressure relief valve 24 connected to the high pressure reservoir 8.

The toy rocket 4 may comprise any material known, although preferably one that is lightweight, such as a plastic, and preferably one that is relatively soft, such as a rubber or polymer foam, so as to increase the safety of the toy rocket 4. The toy rocket 4 is preferably long and thin, such as the shape of a conventional rocket, and may comprise fins (not shown) for aerodynamics and stabilization. An upper tip of the rocket 4 may be substantially conical or rounded so as to improve the rocket's aerodynamics. The upper tip may comprise a relatively soft material, such as a rubber or polymer foam, so that the rocket 4 easily withstands, without breaking the rocket 4, an impact with the ground after a launch of the rocket 4, and also so as to prevent or minimize any injury to a person should the rocket 4 fall on or impact the person after being launched. The rocket 4 may include a cavity, which may be substantially cylindrical, running up an internal length of the rocket 4, so as to be able to accommodate insertion of the nipple 6 such that the toy rocket 4 is configured to mate with the nipple 6 in a substantially piston-cylinder fit.

The high-pressure reservoir 8 is configured to safely contain a gas—preferably air—at a high pressure, the high pressure preferably at least approximately 2 pounds per square inch gauge (psig), more preferably at least approximately 5 psig, and more preferably at least approximately 10 psig. The reservoir 8 may comprise any material known, but is preferably a lightweight material that would be relatively safe in the unlikely event of a breach or explosion, such as a plastic. The reservoir 8 preferably includes a pressure relief valve 24 that is configured to prevent a pressure inside the reservoir 8 from exceeding a predetermined pressure, so as to minimize the risk of overpressurization or explosion of the reservoir 8. Such relief valves are very well known in the art, and may comprise a spring-loaded valve, or may be as simple as a rupture disk type relief valve.

Connected to the reservoir 8 is a valve 26 that is configured, when the valve 26 is open, to allow high-pressure air from the reservoir 8 to pass through the nipple 6 and into the cavity of the rocket 4, to thus create a high (or at least above-ambient) pressure inside the cavity of the rocket 4 that forces and accelerates the rocket 4 from the nipple 6 and thus launches the rocket 4. The valve 26 may be any type of valve known in the art. Preferably, however, the valve 26, whether it is operated electronically, mechanically, pneumatically, hydraulically, etc., is configured to remain open unless both of the releases 14 are operated. In other words, the valve 26 is configured in a series-open configuration, whereby it is closed only when both of the releases 14 are operated. More on this will be discussed later.

Handles 12 may protrude from the sides of the reservoir 8, although they may be located anywhere else on the system 2 as desired. The handles 12 are shaped to be held by opposing hands of a user, preferably comfortably, and thus the handles may comprise a soft, readily grip-able material, such as a foam, rubber, and/or plastic, and may or may not include smoothed notches corresponding to the locations of one's fingers, as understood by one of ordinary skill in the art. The handles 12 includes releases 14 that are configured to be operated by the user to open and close the valve 26, preferably in the series-open configuration as previously discussed, so that both releases 14 must be operated to close the valve 26. The releases 14 may be mechanical spring-loaded buttons connected to the valve 26 so that both buttons must be compressed by the user's hands before the valve 26 closes. The releases 14 could, of course, be any other device known in the art, including but not limited to electronic buttons/switches that are biased open (such as by being spring-loaded), and connected in series to a circuit which, when closed, electrically closes the valve 26. Other variations will be apparent to one of ordinary skill in the art.

Preferably, handles 12 (and more specifically, releases 14) are separated by a distance $d_1$ sufficient to prevent both releases 14 from being operated (e.g., compressed) by a single hand. Preferably, the handles 12/releases 14 are approximately a shoulder width apart, so that the system 2 may be comfortably held by the user's two hands. Preferably, distance $d_1$ is at least approximately 6 inches, more preferably at least approximately 9 inches, more preferably at least approximately 12 inches, and more preferably at least approximately 15 inches. Further, in a preferred embodiment, a distance $d_2$ from the releases 14 to the upper tip of the toy rocket 4 is greater than a maximum distance from a person's hands to the person's face and/or head. For example, the distance $d_2$ may be at least approximately 18 inches, more preferably at least approximately 2 feet, more preferably at least approximately 2.5 feet, more preferably at least approximately 3 feet, and more preferably at least approximately 3.5 feet. An advantage to this feature is that it is difficult, if not impossible, for a person to accidentally launch the rocket 4 into his own face or head.

The pump 10 is preferably a manual pump, but may be any pump known in the art. For example, the pump 10 may be a conventional linear piston pump, similar or substantially identical to the kind conventionally known as a "bicycle pump." Such a pump 10 may comprise a cylinder portion 16 and a piston portion 18 movable inside the cylinder portion, preferably with a tight fit. Air tightness between the piston portion 18 and cylinder portion 16 may be improved by implementing o-rings in the piston portion 18, as understood by one of ordinary skill in the art. The piston portion 18 may be connected to a stirrup 22 via a connecting bar, the stirrup 22 configured to accommodate a user's foot. Further, the pump 10 may include one or more check valves 20 (such as one incorporated within the piston portion 18), configured so as to allow a substantially one-way flow of air through the linear pump 10. For example, as the piston portion 18 is drawn downward relative to the cylinder portion 16 when a user lifts the system 2 relative to his foot (located in the stirrup 22), air is drawn into the cylinder portion 16 via a check valve. Then, when the user reverses the action by pushing the piston portion 18 upward relative to the cylinder portion 16 when he pushes the system 2 down relative to his foot, the air in the cylinder portion 16 is pushed into the reservoir 8 via a check valve. Thus, the pump 10 is configured to enable the user to pump air into the reservoir 8 at least by gripping the two handles 12 connected to the cylinder portion 16 with different hands and inserting his foot into the stirrup 22. By applying a reciprocating up-and-down motion, the user can then pressurize the reservoir 8 with air.

In operation, a user mates the toy rocket 4 to the nipple 6 by sliding the rocket's cavity over the nipple 6 toward the reservoir 8. Next, the user grips handles 12 and operates (e.g., compresses) both of the releases 14 simultaneously. The user inserts his foot into the stirrup 22 and, while operating the releases 14, applies a reciprocating up-and-down motion to pump air into the reservoir 8 with the pump 10. The system 2 may include a pressure gauge (not shown) or other indicator that indicates when the pressure inside the reservoir 8 is sufficient or optimal, and/or the pressure relief valve 24 (such as a spring-loaded type) may serve this purpose by indicating that the reservoir 8 has been fully inflated when the user hears air leaking from the pressure relief valve 24. When the reservoir 8 is optimally pressurized, the user then releases at least one of the releases 14, thus opening the valve 26, and launching the toy rocket 4 by ejecting high pressure air into the rocket's cavity via the nipple 6.

One feature of the toy rocket system 2 according to the present invention is that, because of its shape, configuration, location of the handles 12, and need to operate both releases 14 simultaneously (preferably by different hands) in order to build up pressure inside the reservoir 8, it is very difficult for a user to use the system 2 as a projectile weapon, for several reasons. First, with a user's foot in the stirrup 22 and his hands on the handles 12, the system 2 is positioned so that the toy rocket 4 naturally points upward (which is the direction a toy rocket should go), as opposed to laterally or horizontally, where the rocket 4 might be used as a projectile. Second, even if the user removes his foot from the stirrup 22 after pumping air into the reservoir 8 and attempts to aim the rocket 4 horizontally, the pump cylinder 16 and stirrup 22 protrude toward the user's body in a very awkward, uncomfortable way to dissuade the user from attempting such an action. Third, because the releases 14 are located on handles 12 that are separated by a distance sufficient to prevent a user from operating both releases 14 with one hand, and because the valve is configured in a series-open configuration that requires operation of both releases simultaneously to allow pressure to be increased inside the reservoir 8, a user is required to use both hands to launch the rocket 4. Again, this will dissuade the user from using the system 2 as a projectile weapon, which would ordinarily be a device requiring only a single hand to launch the projectile. Finally, the rocket 4 itself is preferably made from a soft material so as to prevent injury in the case that the rocket 4 does, in fact, impact a person. Further, because the releases 14 on the handles 12 are located a distance from the upper tip of the rocket 4 that is greater than a maximum distance from a person's (such as a child's) hands to her face, the risk of accidentally launching the rocket 4 into one's face is reduced or eliminated.

Figure 2A:
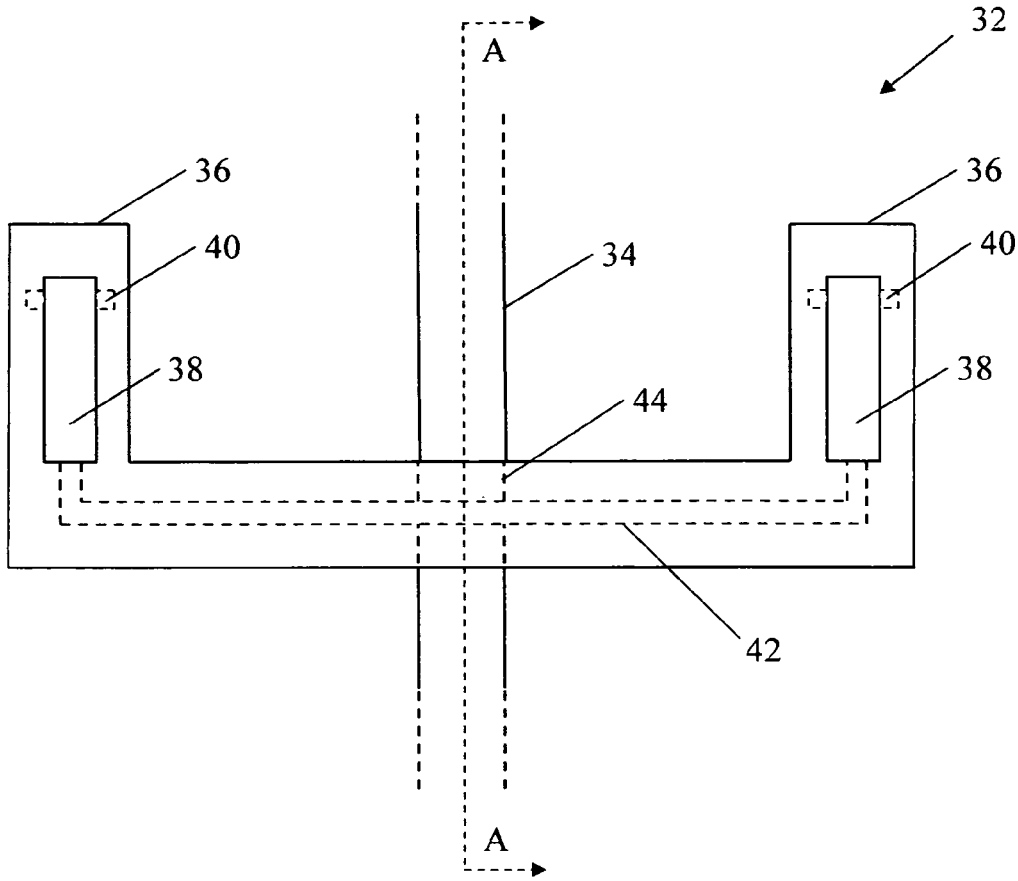
FIG. 2*a* shows a side view of a portion of a toy rocket system according to one embodiment of the present invention, including two releases and a valve.
Figure 2B:
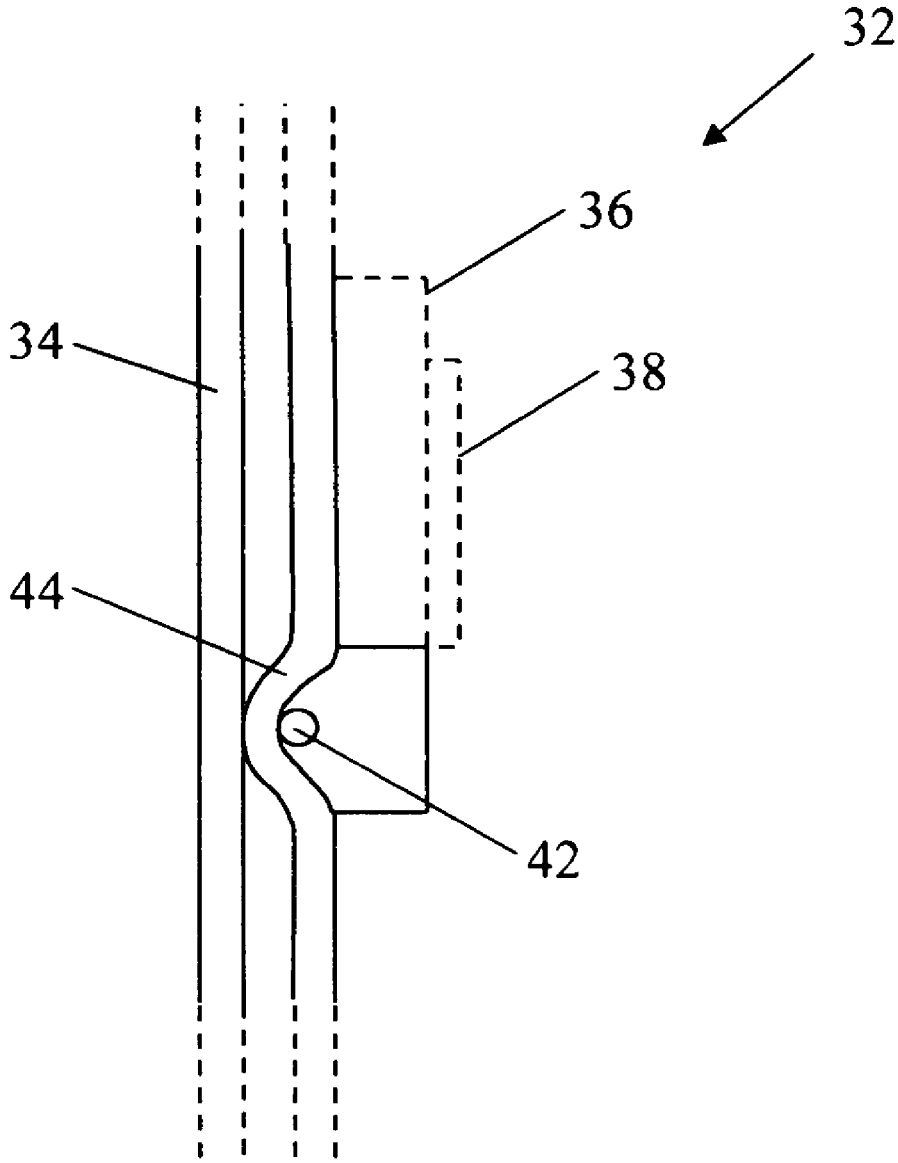
FIG. 2*b* shows a cross sectional view along section A-A of the view shown in FIG. 2*a*.

Referring now to FIGS. 2*a* and 2*b*, a section 32 of a system according to the present invention comprises a tube 34 having a compressible region 44, two handles 36 each having a release 38, and a floating bar 42 connected to the two releases 38. The releases 38 may be spring-loaded extensions that protrude from the handles 36 in a direction perpendicular and upward to the drawing in FIG. 2*a*, and each may pivot along an axis 40. The axis 40 may have substantial "play" to allow the compression or operation of one release 38 without causing the operation of the other release 38, as understood by one of ordinary skill in the art.

The floating bar 42, which may comprise a metal or other hard material, such as a plastic, is configured to push against the compressible region 44 when both releases 38 are compressed/operated, as shown in FIG. 2*b*, so as to prevent passage of air through the tube 34. The compressible region 44 may, e.g., comprise a rubber, polymer foam, etc., which, which the region 44 is compressed by the floating bar 42, prevents passage of air through the tube 34, but which allows passage when not fully compressed. However, the section 32 is configured so that compressing or operating only one release 38 does not operate the other release 38, and hence does not push the floating bar 42 against the compressible region 44 sufficiently to close the compressible region 44 to passage of air. Further, alternatively or in addition to the pressure relief valve 24, the section 32 may be configured so that the floating bar 42 is only able to push on the compressible region 44 so much, such that if the pressure inside the reservoir 8 became excessive, the floating bar 42 could not prevent air from escaping through the compressible region 44 of the tube 34. FIGS. 2*a* and 2*b* do not show the high pressure reservoir 8 or other features of the system 2 shown in FIG. 1, but are intended primarily to demonstrate one possible mechanical configuration of a valve 26, as shown in FIG. 1, as it is connected to the releases 14 in FIG. 1.

Figure 3:
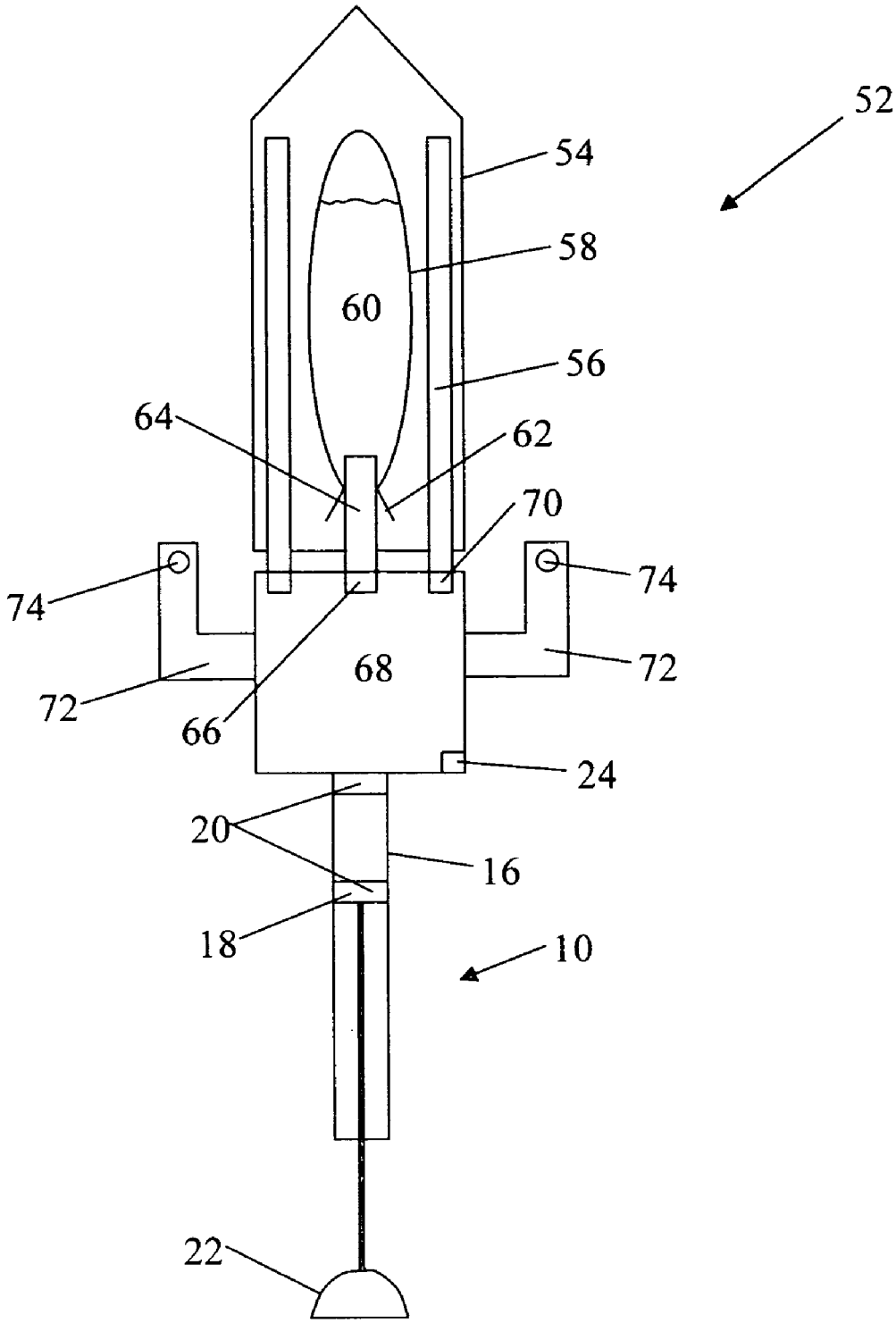
FIG. 3 shows a cross sectional view of a toy rocket system according to one embodiment of the present invention.

Referring now to FIG. 3, a variation of the system 2 in FIG. 1 is shown. The safe air-pressure-launched toy rocket system 52 shown in FIG. 3 comprises a toy rocket 54, two nipples 56, a high pressure reservoir 68, handles 72 each having a release 74, a pressure relief valve 24 (which may be similar to the pressure relief valve 24 in FIG. 1), and a pump 10 (which may be similar to the pump 10 shown in FIG. 1).

The rocket 54 may include a water reservoir 58 configured to contain water 60 under the pressure of high pressure air, and a nozzle 62 may be connected to a lower end of the water reservoir 58. The rocket 54 may be configured so that it may be launched at least in part by the impulse reaction force of water 60 being ejected from the nozzle 62 under the action of high-pressure air, as stored in the water reservoir 58. The toy rocket 54 may also include two sleeves or cavities into which the two nipples 56 may slide in a preferably piston-cylinder type fit (similar to that described with respect to the nipple 6 in FIG. 1). The system 52 may comprise valves 70 that may be similar to valve 26 in FIG. 1, except that, in FIG. 3, there may be two such valves 70, one corresponding to each nipple 56. The valves 70 may be connected to the releases 74 in a series-open configuration, whereby both valves 70 remain open unless both releases 74 are simultaneously operated (e.g., compressed) by the user.

Further, the system may include a nipple 64 configured to slide into the nozzle 62 of the water reservoir 58 so as to prevent water 60 from being ejected from the water reservoir 58 until the user launches the rocket 54. The nipple 64 may include a seal, such as an o-ring (not shown), to help prevent leakage of water 60 from the water reservoir 58, particularly as air pressure increases inside the water reservoir 58. Further, the high pressure reservoir 68 may include a valve 66, such as a check valve, that allows high pressure air from the reservoir 68 to pass through the valve 66 into the water reservoir 58 as the user pumps air into the high pressure reservoir 68 via the pump 10. The valve 66 is preferably a check valve so as to prevent passage of water from the water reservoir 58 back into the high-pressure reservoir 68.

Preferably, because the water reservoir 58 exerts a force against the nipple 64 as the water-filled water reservoir 58 is pressurized with air, the nipple 64 may additionally include a latch or locking mechanism (not shown), connected in a series configuration with the valves 70 (that are connected to releases 74), that is configured to maintain the rocket 54 locked to the rest of the system 52 until the user launches the rocket 54 by releasing at least one of the releases 74. This latch or locking mechanism may or may not be separate from the nipple 64.

The system 52 is preferably configured so that the valves 70 remain closed, and the latch/locking mechanism of the nipple 64 remains locked, until at least one of the releases 74 is released, at which time the valves 70 open (allowing high pressure air to flow into the rocket's cavities via nipples 56, thus exerting an upward force on the rocket 54) and the latching/locking mechanism unlocks, allowing water 60 to be ejected from the water reservoir 58 via the nozzle at a high pressure (providing an impulse reaction force on the rocket 54 that further accelerates the rocket 54 upward, in addition to the upward force imparted by the high pressure air ejected from the nipples 56).

In operation, a user fills the water reservoir 58 of the rocket 54 with water 60. Next, while holding the rocket system 52 upsidedown, the user mates the rocket 54 by inserting the nipples 56 into the rocket's cavities until the rocket 54 is mated as shown in FIG. 3, preferably so that the nozzle 62 abuts against the seal or gasket (if any) of the nipple 64. Next, the user grips the handles and compresses/operates the releases 74, thus closing the valves 70 and locking the latch/locking mechanism of the nipple 64 so as to prevent the rocket 54 from prematurely sliding off the nipples 56. Next, after the user inserts his foot into the stirrup 22, he pumps air into the high pressure reservoir 68 using the pump 10. While this happens, air passes through the valve 66 into the water reservoir 58, so that both the high pressure reservoir 68 and the water reservoir 58 are pressurized to a high pressure. The user continues this until the pressure has reached a desired or optimal pressure (which may be indicated in any manner already discussed, such as with the use of a pressure gauge). Then, the user releases at least one of the releases 74, causing the latch/locking mechanism of the nipple 64 to be unlocked and allowing high-pressure air to flow into the rocket's cavities via nipples 56. As discussed, both of these actions cause forces on the rocket 54 that cause the rocket 54 to launch.

Most of the embodiments described herein have represented simple versions for clarity of explanation. As understood by one of ordinary skill in the art, many of the features and/or aspects of the embodiments described herein may be "mixed and matched" to the extent physically possible to satisfy individual design requirements. Further, variations on the above discussed embodiments are within the scope of the present invention. As one example, the releases 74 in FIG. 3 may be connected by a floating bar, similar to that floating bar 42 shown in FIGS. 2*a* and 2*b*), that may serve to compress compressible regions in the valves 70, but may also abut against a hook region of the latch/locking mechanism of the nipple 64, so that the hook region is only hooked to the floating bar when the releases 74 are compressed, as understood by one of ordinary skill in the art.

I claim:

1. A safe air-pressure-launched toy rocket system, comprising:

an air-pressure-launched toy rocket;

a high pressure reservoir;

a manual air pump connected to the reservoir and configured to enable a user to pump air into said reservoir to a high pressure;

a valve connected to the reservoir and configured, when opened, to release high pressure air stored in said high pressure reservoir to the toy rocket to launch the toy rocket; and two releases configured to be operable by different hands of said user, wherein the releases are connected to the valve in a series-open configuration, whereby said valve is closed only when both of said releases are operated.

2. The safe air-pressure-launched toy rocket system as claimed in claim 1, wherein said mechanical releases are spaced apart by a distance of at least approximately eight inches.

3. The safe air-pressure-launched toy rocket system as claimed in claim 1, wherein said high pressure is at least approximately 5 psig.

4. The safe air-pressure-launched toy rocket system as claimed in claim 1, further comprising a nipple along which the toy rocket slides, wherein the high pressure air is released from the high pressure reservoir to the toy rocket via the nipple.

5. The safe air-pressure-launched toy rocket system as claimed in claim 1, wherein the system is linearly arranged in the following order: the manual air pump; the high pressure reservoir; the valve; and the toy rocket.

6. The safe air-pressure-launched toy rocket system as claimed in claim 1, wherein the system is configured such that, before the toy rocket is launched, a distance between the two releases and an upper tip of the toy rocket exceeds a maximum distance between the hands and head of a person.

7. The safe air-pressure-launched toy rocket system as claimed in claim 1, wherein the system is configured such that, before the toy rocket is launched, a distance between the two releases and an upper tip of the toy rocket is at least approximately two feet.

8. The safe air-pressure-launched toy rocket system as claimed in claim 1, wherein said releases are mechanical.

9. The safe air-pressure-launched toy rocket system as claimed in claim 8, further comprising a floating bar connected between the mechanical releases and configured to close the valve only when both of said mechanical releases apply pressure to said floating bar.

10. The safe air-pressure-launched toy rocket system as claimed in claim 9, wherein the valve comprises a compressible tube, and wherein the floating bar is configured to compress the compressible tube only when both of said mechanical releases apply pressure to said floating bar.

11. The safe air-pressure-launched toy rocket system as claimed in claim 1, wherein said releases are electric.

12. The safe air-pressure-launched toy rocket system as claimed in claim 1, wherein the pump comprises a check valve.

13. The safe air-pressure-launched toy rocket system as claimed in claim 1, further comprising a relief valve connected to the high pressure reservoir.

14. The safe air-pressure-launched toy rocket system as claimed in claim 1, wherein the toy rocket comprises:

a water reservoir configured to contain water; and a nozzle connected to the water reservoir, wherein the pump is configured to enable the user to pump air into the water reservoir to a high pressure.

15. The safe air-pressure-launched toy rocket system as claimed in claim 14, further comprising two nipples along which the toy rocket slides, wherein the high pressure air is released from the high pressure reservoir to the toy rocket via the nipples.

16. The safe air-pressure-launched toy rocket system as claimed in claim 14, wherein the system is configured such that, when the water reservoir contains water and the water reservoir and high pressure reservoir have been pressurized with air, and when the valve is opened, the toy rocket is launched by forces provided from both: a) the high pressure air released to the toy rocket; and b) an impulse reaction caused by water being ejected from the nozzle at a high pressure.

17. The safe air-pressure-launched toy rocket system as claimed in claim 1, wherein the pump comprises a linear piston pump comprising a piston portion and a cylinder portion, wherein the piston portion comprises a stirrup, wherein the pump is configured to enable the user to pump air into the reservoir at least by gripping two handles connected to the cylinder portion with the different hands of the user and inserting a foot of the user into the stirrup.

18. The safe air-pressure-launched toy rocket system as claimed in claim 17, wherein the releases are connected to different ones of the two handles.

19. A method of operating a safe air-pressure-launched toy rocket system, comprising:

providing the safe air-pressure-launched toy rocket system as claimed in claim 17;

gripping the two handles;

inserting the foot into the stirrup;

operating both of the releases to close the valve;

reciprocatingly operating the pump to pump air into the reservoir to the high pressure; and releasing at least one of the releases to launch the toy rocket.

20. A method of entertaining, comprising:

providing to a child the safe air-pressure-launched toy rocket system as claimed in claim 1;

inciting the child to operate the two releases;

inciting the child to pump air into said reservoir to said high pressure by using said manual pump; and inciting the child to release at least one of the two releases to launch the toy rocket.

* * * * *